US008950711B2

(12) United States Patent
Agostini

(10) Patent No.: US 8,950,711 B2
(45) Date of Patent: Feb. 10, 2015

(54) METHOD OF DETECTING AND SIGNALLING A HOT BOX CONDITION

(71) Applicant: Progress Rail Inspection & Information Systems S.r.l., Bologna (IT)

(72) Inventor: Alessandro Agostini, Florence (IT)

(73) Assignee: Progress Rail Inspection & Information Systems S.r.l., Bologna (IT)

( * ) Notice: Subject to any disclaimer, the term of this patent is extended or adjusted under 35 U.S.C. 154(b) by 125 days.

(21) Appl. No.: 13/707,680

(22) Filed: Dec. 7, 2012

(65) Prior Publication Data

US 2013/0270396 A1 Oct. 17, 2013

(30) Foreign Application Priority Data

Apr. 12, 2012 (EP) ..... 12163973

(51) Int. Cl.
*B61K 9/06* (2006.01)
*B61K 9/04* (2006.01)
*B61L 15/00* (2006.01)

(52) U.S. Cl.
CPC ... *B61K 9/06* (2013.01); *B61K 9/04* (2013.01); *B61L 15/0027* (2013.01); *B61L 15/0081* (2013.01)
USPC ..... 246/169 A

(58) Field of Classification Search
CPC ..... F16C 19/525; B61K 9/04; B61K 9/06
USPC ..... 246/169 A; 340/682, 584, 449
See application file for complete search history.

(56) References Cited

U.S. PATENT DOCUMENTS

| | | | | |
|---|---|---|---|---|
| 5,446,451 | A | 8/1995 | Grosskopf, Jr. | |
| RE35,590 | E * | 8/1997 | Bezos et al. | 455/456.1 |
| 5,803,411 | A | 9/1998 | Ackerman et al. | |
| 6,997,520 | B1 | 2/2006 | Barberis et al. | |
| 7,034,711 | B2 | 4/2006 | Sakatani et al. | |
| 7,184,930 | B2 | 2/2007 | Miyasaka et al. | |
| 7,698,028 | B1 | 4/2010 | Bilodeau et al. | |
| 7,705,743 | B2 * | 4/2010 | Barone et al. | 340/682 |
| 8,560,151 | B2 * | 10/2013 | Armitage et al. | 701/20 |
| 2002/0027495 | A1 * | 3/2002 | Darby et al. | 340/298 |
| 2007/0208841 | A1 | 9/2007 | Barone et al. | |
| 2009/0248244 | A1 | 10/2009 | Sumimoto et al. | |
| 2010/0204857 | A1 | 8/2010 | Forrest et al. | |
| 2010/0316316 | A1 | 12/2010 | Kamel | |
| 2011/0115636 | A1 | 5/2011 | Zhang | |

FOREIGN PATENT DOCUMENTS

| | | | |
|---|---|---|---|
| CN | 201923172 | U | 8/2011 |
| EP | 1600351 | A1 | 11/2005 |
| EP | 2138374 | A2 | 12/2009 |
| JP | 2003156037 | A | 5/2003 |
| JP | 2004093256 | A | 3/2004 |
| WO | 0201086 | A2 | 1/2002 |
| WO | 2005105536 | A1 | 11/2005 |

* cited by examiner

*Primary Examiner* — Mark Le
(74) *Attorney, Agent, or Firm* — Miller, Matthias & Hull

(57) ABSTRACT

A method of detecting and signaling a hot box condition on a rail vehicle comprising the steps of acquiring temperature data from undercarriage components of the rail vehicle through temperature sensors provided in hot box detection devices; relaying temperature data through a wireless network of the hot box detection devices to a data recorder.

14 Claims, 2 Drawing Sheets

METHOD OF DETECTING AND SIGNALLING A HOT BOX CONDITION

RELATED APPLICATIONS

This application is based upon and claims the benefit of priority from European Patent Convention Application no. 12163973.6, filed Apr. 12, 2012, the contents of which are expressly incorporated herein by reference.

TECHNICAL FIELD

This disclosure generally relates to the field of rail transportation and to determining a temperature of rail vehicle undercarriage components. In particular, this disclosure relates to detecting temperatures of rail vehicle undercarriage and relaying information relating to the detected temperatures.

BACKGROUND

Safe and reliable operation of a railroad system may be dependent upon the integrity of the rolling mechanisms of the vehicles travelling over the rails, such as trains. Worn or damaged train wheel bearings may increase the rolling friction of the axle thereby increasing the power required to pull the train. In addition, worn or damaged bearings may cause excessive wear to the train axle and, in the case of failure of the bearing, may even cause the axle to lock up, preventing rotation of the wheel and thus resulting in a potential fire hazard due to the heat build up and potential sparking caused by friction of the locked wheel scraping along the rail.

Bearing temperatures may be scanned by sensing a temperature of the wheel bearing indirectly through a bearing box surrounding the wheel bearing on a rail car of a train. When the bearing temperatures are high due to overheating of the wheel bearing a hot box condition may exists. For example, infrared radiation (IR) sensors may be mounted along a rail to detect IR energy emitted by an outer wheel bearing of passing rail cars. The IR energy may be indicative of a temperature of the wheel bearing.

Wheel temperatures may be scanned by sensing a temperature of the wheel directly. When the bearing temperatures are high due to overheating of the wheel a hot wheel condition may exist. For example, infrared radiation (IR) sensors may be mounted along a rail to detect IR energy emitted by an outer wheel bearing of passing rail cars. The IR energy may be indicative of a temperature of the wheel bearing.

However, such a system may be limited to bearing or wheel temperatures being scanned only at specific points on the railway paths. For rail car transporting potentially dangerous or dangerous cargo there may be a need for the bearing or wheel temperatures to be scanned continuously so that any changes in temperature may be detected within a short time.

The present disclosure is directed, at least in part, to improving or overcoming one or more aspects of the prior art system.

BRIEF SUMMARY OF THE INVENTION

In a first aspect, the present disclosure describes a method of detecting and signalling a hot box condition on a rail vehicle comprising the steps of acquiring temperature data from undercarriage components of the rail vehicle through temperature sensors provided in hot box detection devices; relaying temperature data through a wireless network of the hot box detection devices to a data recorder.

In a second aspect, the present disclosure describes a system for performing the method of detecting and signalling a hot box condition on a rail vehicle, the system comprising temperature sensors provided in hot box detection devices to acquire temperature data from undercarriage components of the rail vehicle; and a wireless network of the hot box detection devices for relaying the temperature data to a data recorder.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a device 10 for detecting a hot box/hot wheel condition on a rail vehicle undercarriage component.

Figure 1:
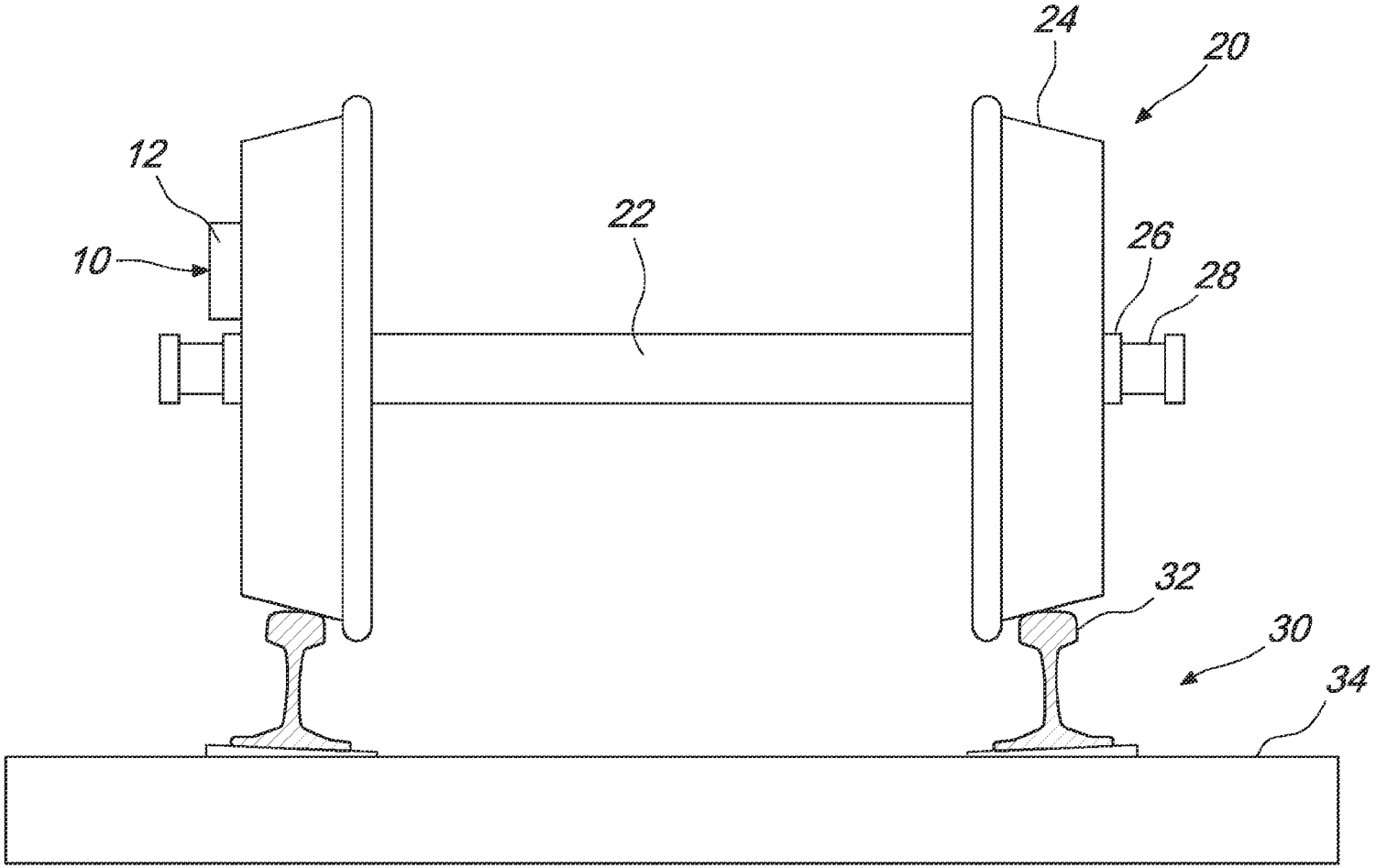
FIG. 1 is a schematic representation of a device for detecting a hot box condition on a rail vehicle undercarriage component according to the present disclosure.

With reference to FIG. 1, the hot box detection device 10 may comprise a housing 12. The housing 12 may have a container-like structure. The housing 12 may have a structure to accommodate the temperature sensor and any required electronics. The housing 12 may be configured so as to be positioned on an undercarriage component of a rail vehicle. The housing 12 may have a suitable shape and structure to be positioned on the undercarriage component. The housing 12 may be composed of thermal insulation materials.

The device 10 may be coupled to the undercarriage component. The housing 12 may be coupled to directly on the undercarriage component. The housing 12 may be suitably coupled to the undercarriage component. In an embodiment, the housing 12 may be removably coupled to the undercarriage component. The housing 12 may be magnetically coupled to the undercarriage component. The housing 12 may be in magnetic contact with the undercarriage component. The magnetic coupling may be sufficiently strong to hold the device 10 as a sole means of direct fastening.

The housing 12 may be provided with a magnet for magnetic coupling to the undercarriage component. The magnet may be disposed within the housing 12. In an embodiment, the housing 12 may be provided with a plurality of magnets for magnetic coupling to the undercarriage component. The plurality of magnets may be disposed within the housing 12 and suitably arranged therein. The magnet or the plurality of magnets may be permanent magnets.

In an embodiment, a portion of the housing 12 may be magnetised for magnetic coupling to the undercarriage component. The portion of the housing 12 in contact with undercarriage component may be magnetised. The portion of the housing 12 may be constituted by a permanent magnet. The portion of the housing 12 may incorporate a permanent magnet. The permanent magnet may be incorporated into a wall of the housing 12.

In an embodiment, the housing 12 may be magnetised for magnetic coupling to the undercarriage component. The housing 12 may be constituted by a permanent magnet. The housing 12 may incorporate a permanent magnet. The permanent magnet may be incorporated into a wall of the housing 12.

The device 10 may further comprise a temperature sensor. The temperature sensor may be positioned within the housing 12. The temperature sensor may detect heat from the target undercarriage component. The temperature sensor may acquire data from the target undercarriage component by detecting the temperature thereof. The temperature sensor may detect a hot box condition or a hot wheel condition through the evaluation of the IR signals emitted from the target undercarriage component.

In an embodiment, the temperature sensor may be an IR sensor for determining the temperature of the target undercarriage component. The infrared sensor may analyze the infrared emissions from the target undercarriage component to determine the temperature thereof. The infrared sensor may be pulsed and/or operated in intervals to consume only low power. Signals from the infrared sensor may be used to determine if hot box condition or a hot wheel condition persists.

The device 10 may comprise other detectors. The device 10 may comprise an acceleration detector to detect additional forces acting on a wheel subjected to scanning by the acceleration detector.

The temperature sensor may be positioned within the housing 12. The temperature sensor may be positioned within the housing 12 in a position that allows heat from the target undercarriage component to be detected. The temperature sensor may be positioned within the housing 12 in a position that allows the temperature of the target undercarriage component to be measured.

The rail undercarriage 20 may comprise components such as an axle 22, wheels 24, wheel bearings 26 and axle stubs 28. The device may be located so as to obtain IR data from the one of the target rail vehicle undercarriage components.

The device 10 may be located on the undercarriage component. The device 10 may be located on the target undercarriage component the temperature of which is to be measured by the temperature sensor. The device may be positioned on the axle 22, wheels 24, wheel bearings 26 or axle stubs 28.

In an embodiment, the device 10 may be located on one undercarriage component adjacent to the target undercarriage component. The device 10 may be positioned on a wheel 24 and orientated to measure the temperatures of the wheel bearing 26 or the axle 22. The device may be positioned on the axle 22 and orientated to measure the temperature of the wheel 24. The device 10 may be positioned on an axle stub 28 and orientated to measure the temperatures of the wheel bearing 26 or the wheel 24.

The rail vehicle may travel on the rails 32 of a rail track 30 that may be positioned on a rail bed, such as within a cross tie or a sleeper 34.

The device 10 may be provided with electronics which includes a controller to control the temperature sensor. The controller may analyse the signals from the temperature sensor. The electronics may be configured to communicate wirelessly. The electronics may be configured to operate within a wireless network.

The device 10 may be powered by a battery. The temperature sensor may be powered by the battery. The electronics and associated controller may be powered by the battery. In an embodiment, the battery may be a lithium battery which is able to provide a power supply over a period of 1 to 2 years.

In an embodiment, the device 10 may be powered through rotational acceleration. The temperature sensor may be powered through rotational acceleration. The electronics and associated controller may be powered through rotational acceleration. The rotation force on the temperature sensor may generate electrical power for the operation of the temperature sensor.

The housing 12 is supported on the undercarriage component, and the housing 12 may support a generator configured to produce electrical power when the undercarriage component, such as a rail vehicle wheel or axle, turns as the rail vehicle moves. Circuitry may be supported in the housing 12 and may receive the electrical power.

Electrical power may be generated through electromagnetic induction. In an embodiment, the power supply may be an electromagnetic generator. The power source may comprise a magnetic core. In an embodiment, the magnetic core may have a plurality of stationary permanent magnets that are arranged in succession in the circumferential direction, with their poles alternating. The power supply may further comprise a winding encircling the magnetic core. The magnetic core may produce a magnetic flux which passes through the winding and also passes through an air gap. A ring having teeth may be positioned such that the teeth may pass through the air gap when the ring rotates. The air gap may be between the magnetic core and teeth provided on the ring.

When the ring rotates, the teeth move through the air gap between the alternating polarity poles, causing change in flux linkage with the winding and inducing voltage across the winding. The power supply may contain a full wave rectifier and a voltage regulator which converts the alternating current generated in the winding to direct current.

In an embodiment, the ring may be rotatably mounted in the housing 12. The ring may be weighted such that as the undercarriage component rotates the weight would tend to remain in its lowest position in the housing 12. The position which would be equivalent to the weight rotating within the housing 12 in the opposite direction as the rotation of the undercarriage component.

As the undercarriage component rotates, the magnetic core may rotate relative to the ring and the teeth. The relative rotation may move the teeth though the air gap so as to induce a voltage. The voltage may be used to supply power to the device 10 and the components therein.

Figure 2:
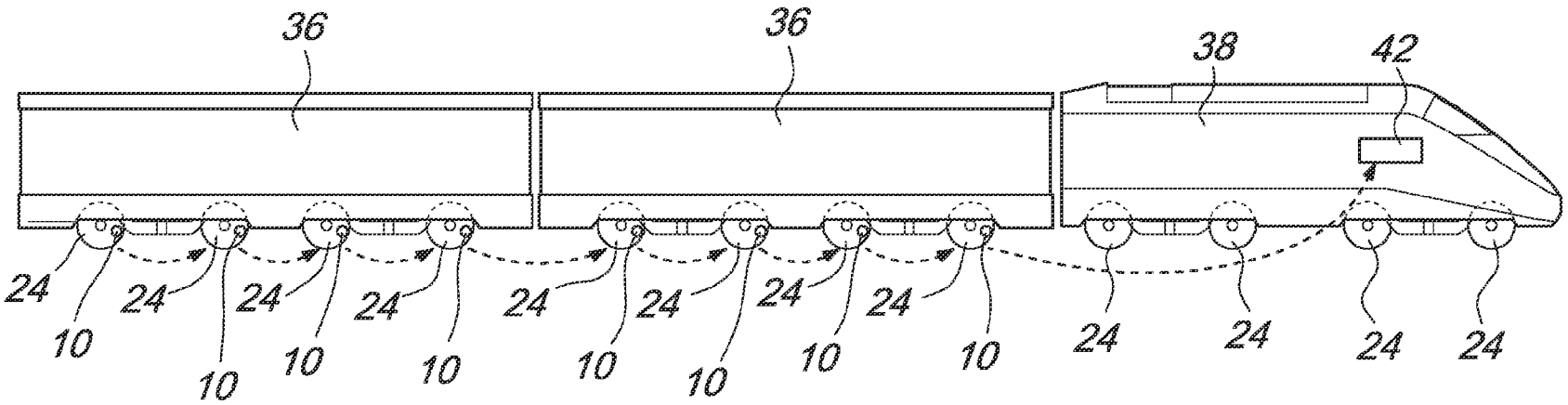
FIG. 2 is a schematic representation of a system for detecting a hot box condition on a rail vehicle undercarriage component according to the present disclosure.

With reference to FIG. 2, this disclosure also relates to a system 40 for performing a method of detecting and signalling a hot box condition on a rail vehicle 36. The system 40 may comprise the devices 10 for detecting a hot box condition on a rail vehicle undercarriage component.

The system 40 may comprise temperature sensors for acquiring temperature data from undercarriage components of the rail vehicle 36. The temperature sensors may be disposed in the devices 10. The system may comprise a wireless network of the devices 10 for relaying the temperature data to a data recorder 42.

In an embodiment, the data recorder 42 may be located in a rail vehicle 36. In an embodiment, the data recorder 42 may be located in a locomotive 38 to which a plurality of rail vehicles 36 are linked.

The devices 10 may be removably coupled to the undercarriage components. The devices 10 may be coupled magnetically to the undercarriage components. The undercarriage components may be rotating components. The devices 10 may be positioned on the axle 22, wheels 24, wheel bearings 26 or axle stubs 28.

The devices 10 may be powered through rotational acceleration force. The devices 10 may be powered through a battery.

The devices 10 may be magnetically coupled to undercarriage components.

In operation, the devices 10 may be switched on sequentially starting from locomotive 38 end towards the end of the train. For instance, each device 10 may self configure within a wireless network of the devices 10 at activation.

In an embodiment, the devices 10 may be configured to transmit data to the nearest device 10. In an embodiment, the devices 10 may be configured to transmit data to the nearest active device 10 from the locomotive 38 side of the train. In FIG. 2 the arrows may indicate the relay of data from a device 10 to the next nearest active device 10 from the locomotive 38 side of the train. The data may be relayed to the data recorder 42.

In an embodiment, each device 10 may be configured so as to transmit data to all the other devices 10. Each device 10 may be configured so as to transmit data to all other devices 10 which are nearer to the locomotive 38. The broadcast of the data may ensure that multipath and redundant transmissions up to the first device 10 proximate to the locomotive 38.

The device 10 next to the locomotive 38 may transmit a signal to the data recorder 42. The data recorder 42 may have a display to provide information to the train driver. The data recorder 42 may have an alarm display to inform the train driver of any dangerous condition.

A method of detecting and signalling a hot box condition on a rail vehicle may comprise the step of acquiring temperature data from undercarriage components of the rail vehicle. The temperature data may be acquired through temperature sensors provided in the devices 10. The method may further comprise relaying the temperature data through a wireless network of the devices 10 to a data recorder.

The method may comprise the steps of sequencing the devices 10 and relaying the temperature data detected by each of devices 10 to the next device 10 in the sequence.

The method may comprise the step of broadcasting the temperature data detected by each of the devices 10 to the remaining devices 10 in the network.

The method may comprise the step of transmitting the temperature data to wayside stations. The wayside stations may be positioned along the train track 30. The wayside stations may be positioned at intervals along the train track 30. The temperature data may be transmitted to wayside stations by the data recorder 42.

The method may comprise the step of powering the devices 10 through rotational acceleration force.

The method may comprise the step of coupling the device 10 to each undercarriage component wherein the housing 12 is coupled magnetically.

The skilled person would appreciate that foregoing embodiments may be modified or combined to obtain the device 10 or the system 40 of the present disclosure.

Industrial Applicability

This disclosure describes a device 10 which can be positioned with ease on the rail vehicle undercarriage component. The device 10 may be temporarily coupled to the rail vehicle undercarriage component. Such a temporary coupling may avoid the need for the device 10 to be manufactured as a part of the rail vehicle undercarriage component. Thus, the device 10 may be assembled without the need for retrofitting the under carriage component. The device 10 may be decoupled from the undercarriage component after use without undue effort. The device 10 may be used as a consumable item.

The device 10 may be in direct contact with the rail vehicle undercarriage component and thereby may be able to measure the temperature of the component directly.

This disclosure describes a system 40 comprising a network of devices 10 which are linked wirelessly for the transmission of data. The data acquired by a device 10 may be transmitted from said device to the next device 10 in line from the data recorder 42. The data may be relayed through the series of devices 10 to the data recorder 42.

The data may be relayed through a series of devices 10 in sequence. The data may be broadcast from one device 10 to other devices 10 in the network. The network of devices 10 may ensure multipath and redundant transmissions.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

What is claimed is:

1. A method of detecting and signaling a hot box condition on a rail vehicle comprising the steps of:

acquiring temperature data from undercarriage components of the rail vehicle through temperature sensors provided in hot box detection devices arranged in a sequence leading to a data recorder; and relaying the temperature data through a wireless network of the hot box detection devices to the data recorder by sequentially transmitting the temperature data from one of the hot box detection devices in the sequence through each of the remaining hot box detection devices in the sequence that are nearer to the data recorder.

2. The method of claim 1 comprising the steps of sequencing the hot box detection devices and relaying the temperature data detected by each of the hot box detection devices to the next hot box detection device in the sequence.

3. The method of claim 1 comprising the step of broadcasting the temperature data detected by each of the hot box detection devices to the remaining hot box detection devices in the network.

4. The method of claim 1 comprising the step of transmitting the temperature data to wayside stations.

5. The method of claim 4 further comprising the step of transmitting the temperature data to wayside stations from the data recorder.

6. The method of claim 1 comprising the step of powering the hot box detection devices through rotational acceleration force.

7. The method of claim 1 comprising the step of magnetically coupling a hot box detection device to a corresponding undercarriage component.

8. A system for detecting and signaling a hot box condition on a rail vehicle, the system comprising:

a plurality of temperature sensors provided in a corresponding plurality of hot box detection devices for acquiring temperature data from undercarriage components of the rail vehicle, the plurality of hot box detection devices being arranged in a sequence leading to a data recorder; and a wireless network of the hot box detection devices configured to relay the temperature data to the data recorder by sequentially transmitting the temperature data from one of the hot box detection devices in the sequence through each of the remaining hot box detection devices in the sequence that are nearer to the data recorder.

9. The system as set forth in claim 8 wherein each hot box detection device is magnetically coupled to a corresponding undercarriage component.

10. The system as set forth in claim 9 wherein each undercarriage component is a rotating component.

11. The system as set forth in claim 10 wherein at least one undercarriage component is a wheel.

12. The system as set forth in claim 10 wherein at least one undercarriage component is an axle.

13. The system as set forth in claim 8 wherein at least one hot box detection device is powered by rotational acceleration force.

14. The system as set forth in claim 8 wherein at least one hot box detection device is battery powered.

* * * * *

UNITED STATES PATENT AND TRADEMARK OFFICE

CERTIFICATE OF CORRECTION

PATENT NO. : 8,950,711 B2
APPLICATION NO. : 13/707680
DATED : February 10, 2015
INVENTOR(S) : Alessandro Agostini It is certified that error appears in the above-identified patent and that said Letters Patent is hereby corrected as shown below:

In the specification

Column 5, line 51, delete "Industrial Applicability" and insert -- INDUSTRIAL APPLICABILITY --.

Signed and Sealed this
Twenty-ninth Day of December, 2015

Michelle K. Lee

Michelle K. Lee
*Director of the United States Patent and Trademark Office*